US005430626A

United States Patent [19]

Leffel

[11] Patent Number: 5,430,626

[45] Date of Patent: Jul. 4, 1995

[54] ILLUMINATED DISPLAY CONSTRUCTION

[75] Inventor: Jeffry M. Leffel, Flushing, Mich.

[73] Assignee: Star Of Hope, Inc., Flushing, Mich.

[21] Appl. No.: 265,223

[22] Filed: Jun. 24, 1994

[51] Int. Cl.[6] ..... F21P 1/00

[52] U.S. Cl. ..... 362/121; 362/252; 362/807

[58] Field of Search ..... 362/121, 252, 249, 806, 362/807

[56] References Cited

U.S. PATENT DOCUMENTS

| | | | |
|---|---|---|---|
| 1,707,539 | 4/1929 | Propp . | |
| 1,722,399 | 7/1929 | Snodgrass . | |
| 1,832,576 | 11/1931 | Palmer . | |
| 2,047,045 | 7/1936 | Veenboer . | |
| 2,228,437 | 1/1941 | Blana . | |
| 2,297,191 | 9/1943 | Parman . | |
| 2,605,386 | 7/1952 | Syretz | 362/227 |
| 3,184,366 | 5/1965 | Claude | 362/807 |
| 3,400,263 | 9/1968 | Yakim | 362/252 X |
| 4,339,787 | 7/1982 | Burnbaum | 362/252 X |
| 4,639,841 | 1/1987 | Salestrom et al. | 362/252 |
| 4,783,726 | 2/1931 | Christastie | 362/121 |
| 4,956,757 | 9/1990 | Wang | 362/252 |
| 5,077,646 | 12/1991 | Parsons | 362/121 X |
| 5,197,798 | 3/1993 | Tickner | 362/235 |
| 5,213,409 | 5/1993 | Fisher . | |

FOREIGN PATENT DOCUMENTS

| | | |
|---|---|---|
| 2713834 | 9/1978 | Germany . |
| 329477 | 9/1935 | Italy . |

*Primary Examiner*—Ira S. Lazarus
*Assistant Examiner*—Thomas M. Sember
*Attorney, Agent, or Firm*—Reising, Ethington, Barnard, Perry & Milton

[57] ABSTRACT

A light display structure (10) includes a plurality of arm braces (12) mounted together with a decorative shield (22) fastened thereon. Each arm brace (12) includes a short arm (16) and long arm (15) angularly extending from a central bite section (14). The plurality of arms can be mounted at the bite section to form a central hub (18) or mounted at the distal ends (94) of each arm to form a five pointed star with the bite section forming the outer points of the star.

19 Claims, 6 Drawing Sheets

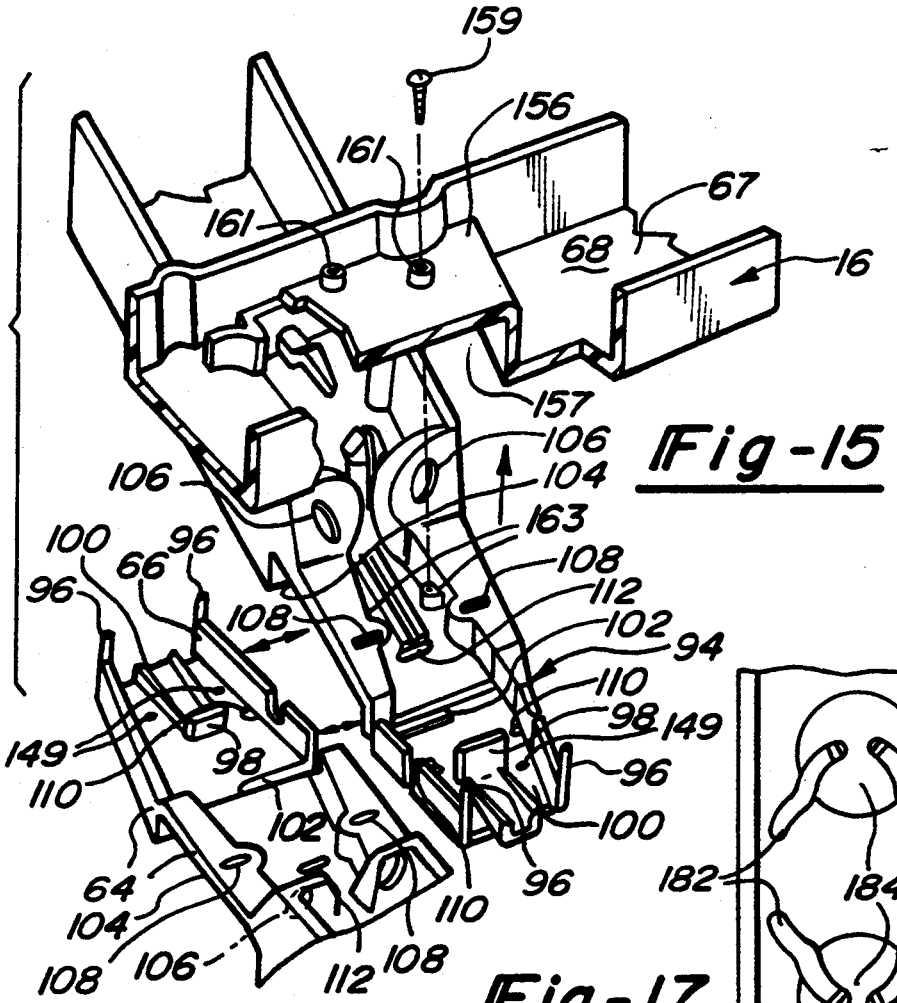
Fig-15
Fig-17
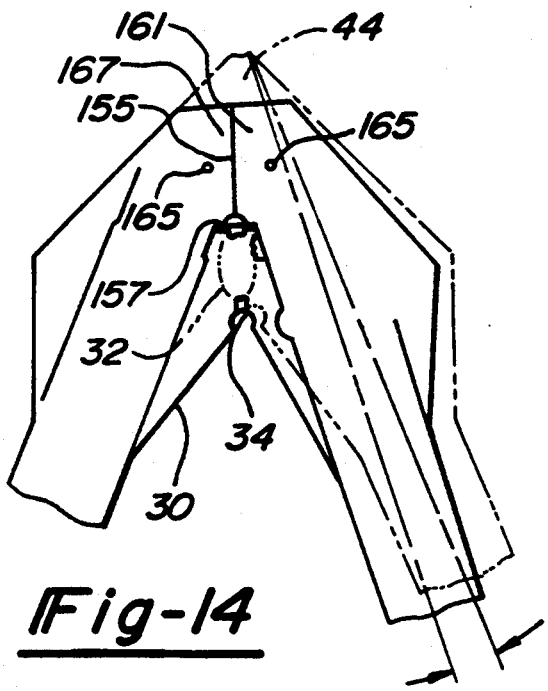
Fig-14
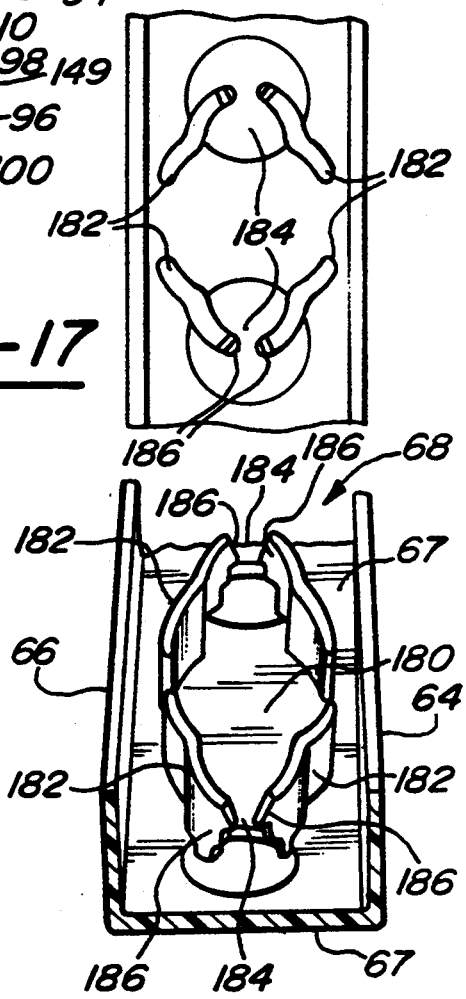
Fig-16

ILLUMINATED DISPLAY CONSTRUCTION

TECHNICAL FIELD

The field of this invention relates to lighted displays and more particularly to ornamental lighted displays such as for Christmas displays.

BACKGROUND OF THE DISCLOSURE

Illuminated ornamental displays are popular during the Christmas season. Besides lights being placed on Christmas trees, illuminated star displays are often mounted on exterior walls. These stars can have various shapes such as a star with four main legs or points, a pointed star with elongated lower legs often referred to as the Star of Bethlehem, or a star with five legs. The lights are placed along each leg of the star. During nighttime hours, the lights are illuminated to form a decorative display.

The exterior displays are known to be made of wire structure and are not attractive during daytime nor are they economically made with each design being formed from its own components with hardly any common components between the different designs. Furthermore the string lights are often merely wrapped about the wire frame via its electrical wire and thus the lights haphazardly point in different directions. The haphazard display has some lights pointed in directions other than the desired direction. Hence, the density of light shining toward the display area is diminished. To compensate, the lights are more densely wrapped about the wire frame to increase the density or illumination to the desired level which increases the expense of the decorative display and wastes electrical energy.

What is needed is a display construction that can be used to form a variety of displays with the use of common components and can be attractive during daytime hours as well as nighttime hours while correctly positioning the individual lights of the string lights.

SUMMARY OF THE DISCLOSURE

In accordance with one aspect of the invention, a display structure for mounting ornamental lights includes a plurality of arm braces connected together. The arm braces have a respective short arm and a respective long arm integrally formed together with a central bite section. The short and long arms have opposing upwardly extending side walls and a center floor wall forming a channel. Each arm and channel has an open distal end that is connectable with an open distal end of an arm of another arm brace to form a continuous channel between the two arm braces. At least one arm is constructed to provide a light socket holder for a light socket in a light string that points the light upwardly in the channel. The light socket holder has upright walls with the end portions of the walls forming two slots therebetween on opposite sides of the socket holder. The two slots are spaced along the channel. The end portions of the wall are flexible and resilient to allow a wire of string light to extend along the channel and enter and be retained within the slots.

The channel in the long arm has a raised portion with a angled tunnel thereunder. The raised portion overlies the connected distal ends of another two braces such that said distal ends extend through said tunnel and the braces all lie substantially coplanar. The connected distal ends each has a slot extending perpendicular to the length of the channel. The distal end has a nesting recess for receiving upwardly extending walls at the distal end of another arm brace when said distal ends are engaged in the slot of the other arm brace.

The display structure has the arm braces arranged to form a five point star structure with the bite sections of a first set of braces forming a point of the star structure. One five point arm structure incorporates a first and second set of arm braces with a short and long arm angled with respect to each other. An arm brace of the second set is interposed between ends of respective arm braces of the first set to form inner corners of the five point star structure. The bite section of the first set forms the outer points of the star structure.

Alternately, the display structure has a plurality of arm braces connected together at the central bite section to form a center hub. The bite section has an upraised corner. The side walls of the arms have a slot thereunder spaced from the upraised corner. A lock ring has a central opening. The ring fits snugly in the slot between the floor of the bite section and the side walls. The raised corners of a plurality of the arm braces extend through the central opening such that the raised corners are pressed fitted in the opening. The arms are locked onto the ring and radially extend outward from the center hub at circumferentially spaced positions thereabout. Preferably four arm braces are used with the raised corner being a quadrant shaped. The side walls of adjacent arm braces abut each other and have an alignment device such as a slot and tab that secures the respective side walls in the correct position together.

An appropriately shaped decorative shield is attachable to the arm braces to cosmetically cover a substantial portion of the arm braces. The decorative shield has apertures therethrough aligned with the socket holders to allow lights mounted in the socket holders to be visible through the apertures or to extend through the apertures.

In accordance with another aspect of the invention, an arm brace for a decorative display light structure includes a short arm and a long arm integrally formed with a center bite section. A supporting web section is interposed between the short and long arms of the brace to retain the long and short arms at approximately a 45 degree angle. The bite section has a fastener system for connecting with another bite section of another like brace such that a plurality of short and long arms radiate outwardly from a formed center hub section at approximately a 45 degree angle from sequential radiating arms.

The supporting web section has a centrally disposed rigidifying member. The rigidifying member can be cut from the web section and the bite section can be radially cut to allow the arms to angularly flex toward each other to change the angle from said approximately 45 degree angle to approximately a 36 degree angle. Each arm and channel has an open distal end that is connectable with an open distal end of an arm of another arm brace to form a continuous channel between the two arm braces and form a five pointed star structure with the bite section forming the outer points of the star. The distal end of each arm has a slot extending perpendicular to the length of the channel. The distal end has a nesting recess for receiving upwardly extending walls at the distal end of another arm brace when the distal end is engaged in the slot of the other arm brace.

At least one arm is constructed to provide a light socket holder for a light socket in a light string that points the light upwardly in the channel.

The arm brace has an arm with a raised portion with an angled tunnel. The raised portion is constructed to overly the distal ends of another two identical braces such that said distal ends are able to extend through said tunnel and said braces are able to lie substantially coplanar.

In this manner, an arm brace component can be used to assemble a variety of differently shaped decorative display light structures with each structure mounting a plurality of lights in a string light and be covered with a decorative shield leaving the lights visible or extending through the shield.

BRIEF DESCRIPTION OF THE DRAWINGS

Reference now is made to the accompanying drawings in which:

FIG. 14 is a schematic and fragmentary plan view of an arm brace with the raised corner removed, the rigidifying member removed and the bite section cut to allow angular movement of the two arms of the arm brace;

FIG. 15 is an explode and fragmentary view of the interconnection of three arm braces in the third embodiment as shown in FIG. 3;

FIG. 16 is an enlarged fragmentary view illustrating an alternate embodiment of the light socket holder located in the channel of the arm brace; and FIG. 17 is a plan view of the light socket holder shown in FIG. 16.

DETAILED DESCRIPTION OF THE PREFERRED EMBODIMENT

Figure 1:
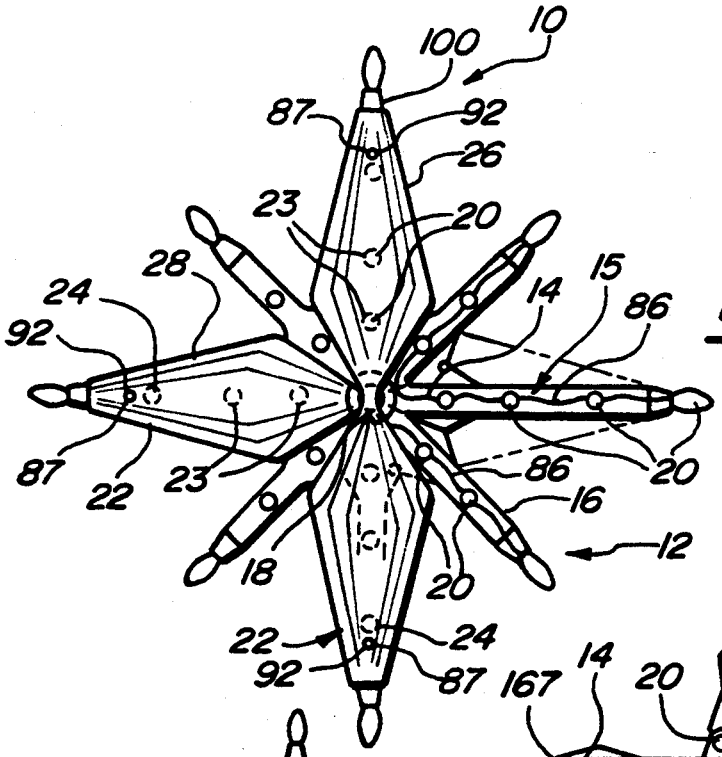
FIG. 1 is a schematic plan and partially segmented view of a lighted display structure illustrating one embodiment in accordance with the invention.

Referring now to FIG. 1, a decorative light display 10 has a plurality of arm braces 12 mounted together at their respective bite sections 14 such that a plurality of long arms 15 and short arms 16 are circumferentially spaced about the central hub section 18 of the display and radially extend outwardly. The arm braces 12 are made from molded plastic such as polypropylene. Each arm 15 and 16 has a plurality of lights 20 spaced therealong. The lights are commonly known as Christmas string lights. A commercially available C-9 or C-7 sized string can be used with the arm braces 12. For simplicity of the drawings, the commercially available lights 20 are not shown in detail in FIGS. 5–17.

A molded plastic decorative shield 22 with apertures 24 can be mounted over the arm braces 12 such that it covers a substantial portion of the arm braces 12. The shield 22 can be fastened to the arm braces by a screw or snap fitted on. The shield 22 may have a first half 26 and second half 28 that overlie each other to form shield 22. The shield has a number of apertures 23 therethrough that are aligned over the lights 20 to allow the lights 20 to extend therethrough and be visible therethrough.

Referring to FIGS. 5–9, the assembly of the arm braces 12 as shown in FIG. 1 is now described. The arm brace 12 has an inner web 30 with an arcuate flexing section 34 at a midpoint. A rigidifying brace 32 extends from the bite section 14 that prevents the flexing section 34 from flexing while its connected thereto and supports the arms 15 and 16 at approximately a 45° angle.

The following structure is used to connect the respective arm braces 12 together. Two outer webs 36 and 37 have walls 38 and 39 that are spaced at 90° from each other. The wall 38 had a tab 46 and slot 48 that engage complementary slot 47 and tab 49 on wall 39 as shown in detail in FIG. 9. The inner ends 40 and 41 of the walls 38 and 39 are spaced from the bite section to form a slot 42 and 43 respectively therebetween. The bite 14 has a raised corner quadrant 44 with arcuate outer wall 45.

Four arm braces 12 are assembled such that the quadrants form the central circular hub 18. The walls 38 and 39 are vertically disposed to flushly abut each other when the tabs 46 and 49 engage respective slots 48 and 47. A connecting ring 52 in the form of a flat large washer has its central opening 54 snugly receiving the hub 18. The ring 52 has a thickness such that the outer periphery 56 of ring 52 snugly fits in slots 42 and 43.

Figure 8:
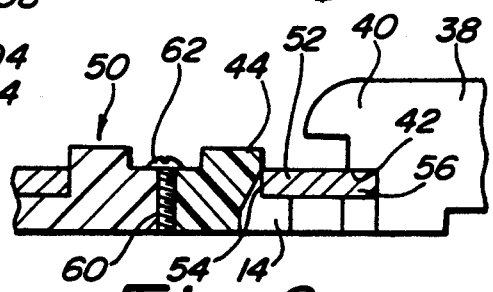
FIG. 8 is a cross sectional view taken along lines 8—8 shown in FIG. 7.
Figure 9:
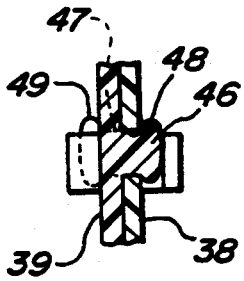
FIG. 9 is a cross sectional view taken along lines 9—9 shown in FIG. 7.
Figure 7:
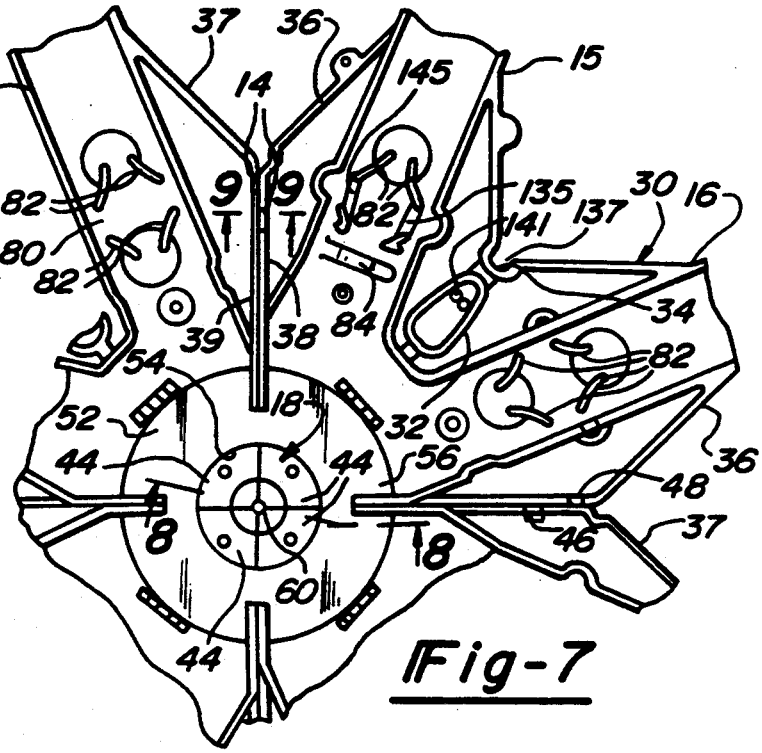
FIG. 7 is an enlarged plan view of the hub section of the first two embodiments with the decorative shield removed.
Figure 6:
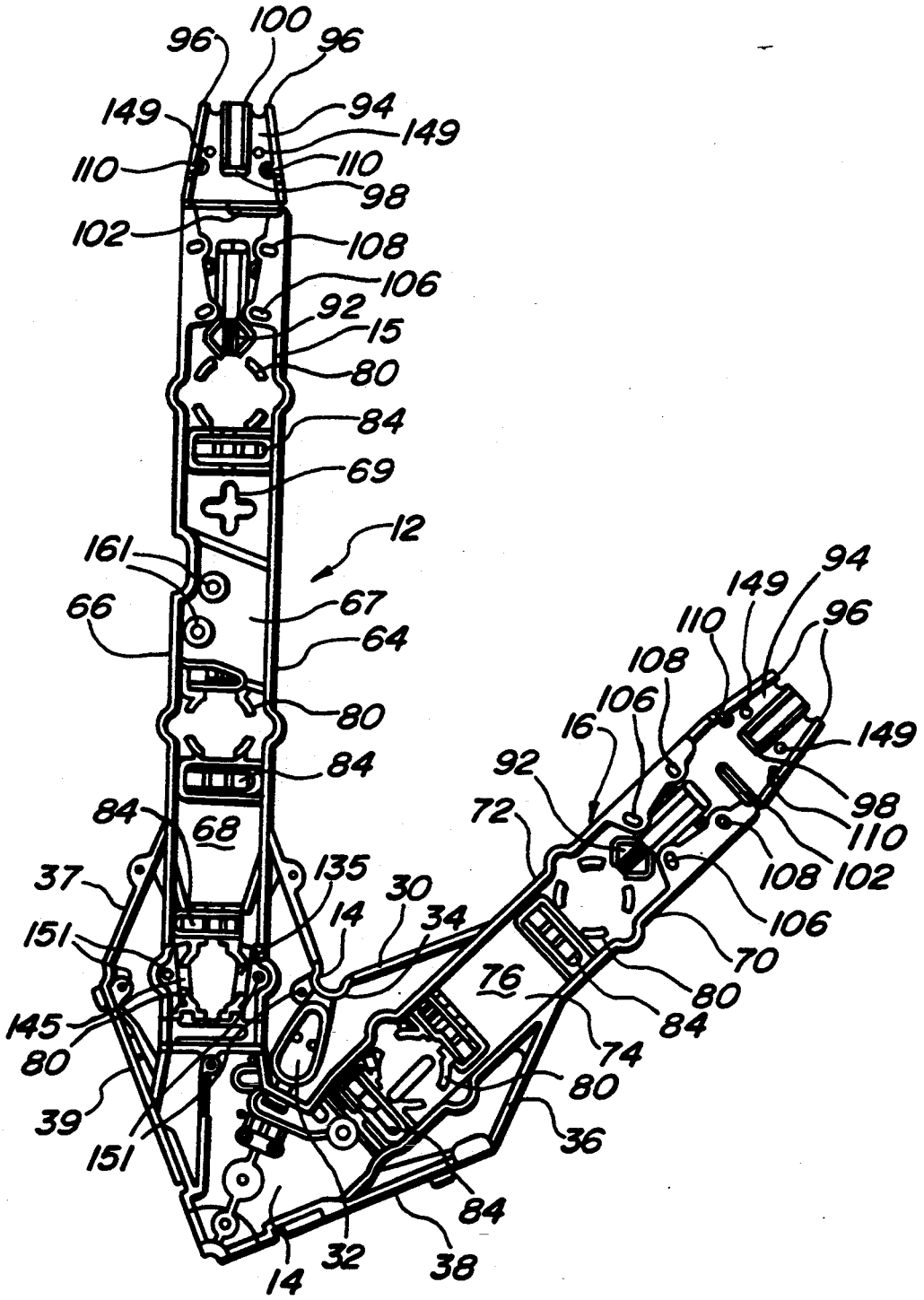
FIG. 6 is a plan view of the arm brace shown in FIG. 5.

To further secure the arm brace assembly together, the quadrant corner 44 has a notch 58 therein that forms a screw hole 60 with the other three notches 58. An oversized screw 62 as shown in FIG. 8 expands the quadrants 44 outwardly to forman interference press fit connection. The screw 62 can also be used to fasten a centrally located cup-like socket holder (not shown) for an optional light 20 that would be located at the center of the hub 18.

The arm brace 12 has long arm 15 with upwardly extending side walls 64 and 66. A floor 67 spans between walls 64 and 66 and forms an elongated channel 68. Similarly, short arm 16 has upwardly extending side walls 70 and 72 and floor 74 that define elongated channel 76. Floor 67 has an cross shaped aperture 69 to provide mounting on a hook or nail in a wall or other support structure to mount the decorative light display 10 in a desired position.

Each arm 15 and 16 have similarly structured light socket holders 80. Long arms 15 has three such socket holders 80 while short arm 16 has two holders 80. The holders 80 in arm 15 will now be described with the understanding that the holders 80 in arm 16 are substantially the same. Each light socket holder 80 has upright wall segments 82 that are spaced apart to retain a socket base of a C-9 or C-7 Christmas light string such that the light is pointed upwardly in the channel 68. Each side of holder 80 has a spring clip 84 that secures the wiring 86 electrically connecting lights 20 together.

An alternate holder 180 is disclosed in FIGS. 16 and 17. In this embodiment, spaced upright walls 182 are contoured and sized to retain a socket of a C-9 sized Christmas light string. The distal ends 186 of walls 182 form two slots 186. The distal ends are forms with an aperture 188 in floor 67 such that the distal ends 186 are free to flex to allow the electrical wire 86 to fit through enlarged slot 184 and be retained therein when the distal ends 186 resiliently flex back to their relaxed normal state.

Posts 90 in both arms 15 and 16 have a snap fastener 92 at its top end that can attach to an appropriately sized aperture 87 in shield 22 to retain the shield 22 on the assembly of arm braces 12.

Figure 2:
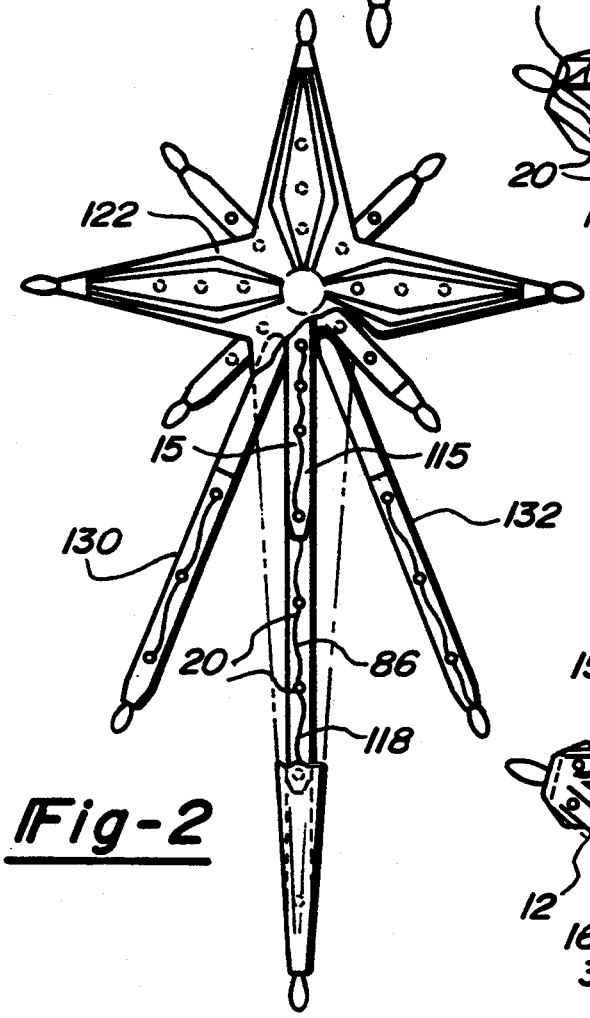
FIG. 2 is schematic plan view of a second embodiment of the invention.

Each arm 15 and 16 has an identically structured distal end 94. The distal end 94 on arm 15 will now be described with the understanding that the distal end 94 on arm 16 is substantially identical. The side walls 64 and 66 have their height being cut to approximately half the height at the rest of the arm. The walls are also tapered to each other and terminate in two upright posts 96. A central upright tab 98 is spaced from posts 96 to form a distal socket holder 100 that can be used to hold a light at the distal end as shown in FIGS. 1 and 2. A slot 102 extends approximately half way across the arm 15 and is perpendicular to channel 68. An undercut nesting recess 104 extends from the slot 102 toward bite section 14 under each wall 64 and 66. The undercut recess 104 is sized to receive walls 64 and 66 of a similar distal end of another arm brace 12 when the two are engaged through slots 102 as shown in the exploded view of FIG. 15. Holes 106 are located to receive posts 96 of another distal end through its bottom end. Slot 112 is sized to receive tab 98 from its bottom of another distal end 94. Screw holes 108 and 110 are alignable from respective distal ends 94 to receive four threaded fasteners to secure the two distal ends together.

Figure 3:
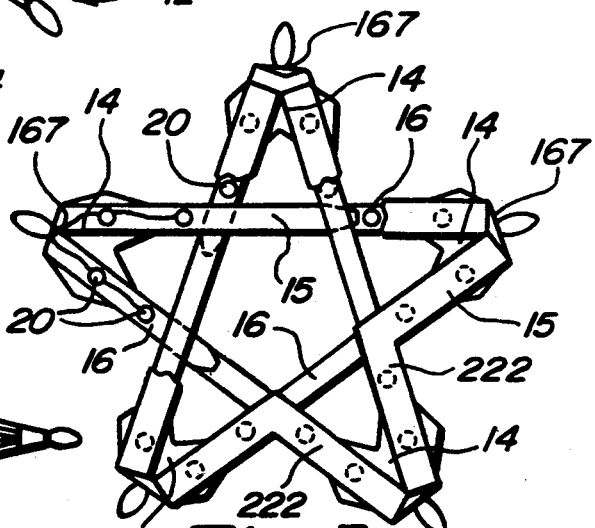
FIG. 3 is similar view of a third embodiment of the invention.
Figure 4:
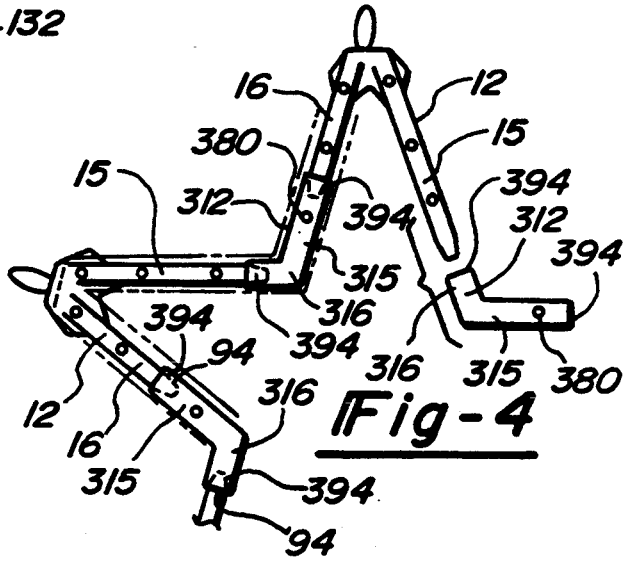
FIG. 4 is a fragmentary plan view illustrating a fourth embodiment of the invention.
Figure 5:
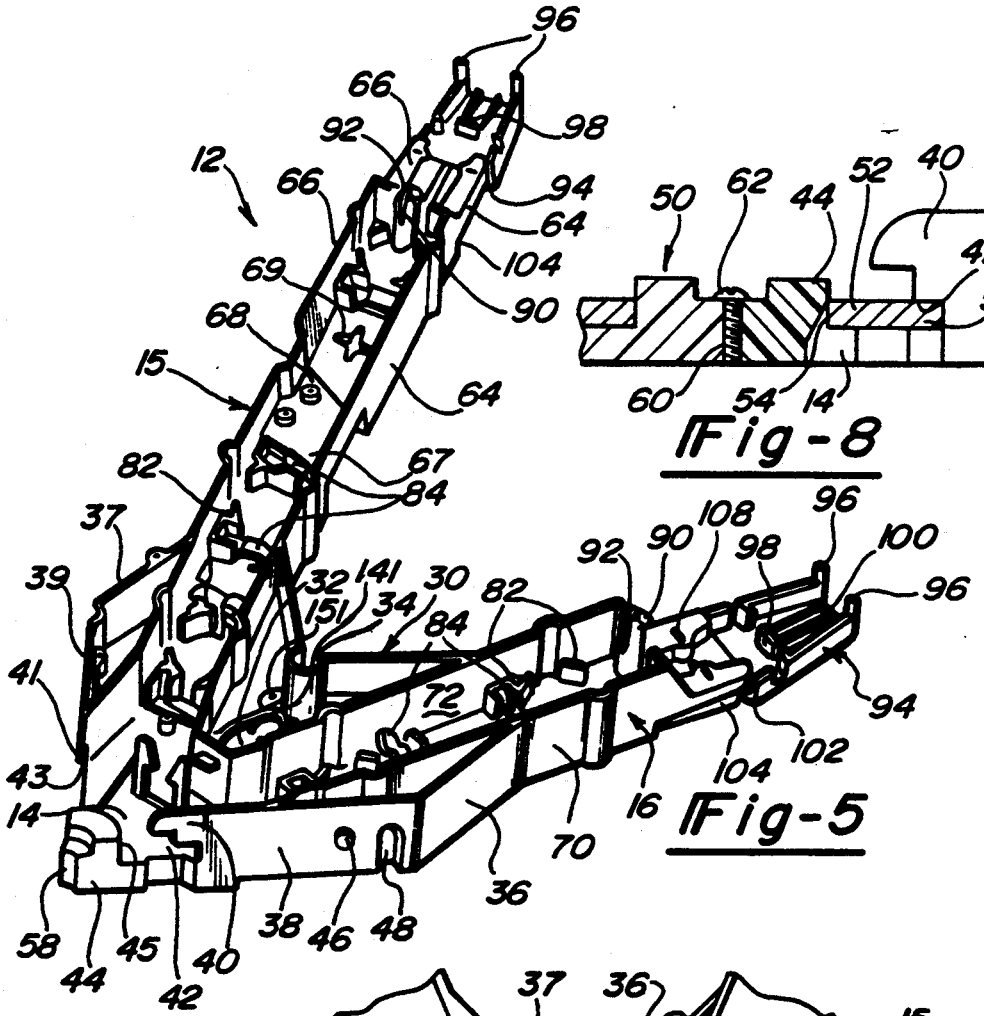
FIG. 5 is a plan view of the arm brace used to assemble the embodiments shown in FIGS. 1–4.

Such a connection between two distal ends 94 is desirable for the assembly of the star structures shown in FIGS. 3, 4, and 5 as further described.

Referring now to FIGS. 2, 10–13, the arm 15 is extended by the attachment of a leg 118 that is formed from an arm brace 12. The embodiment shown in FIG. 2 is assembled substantially the same as the first embodiment with the addition of leg 118 on bottom arm 15 to form long arm 115 and the addition of legs 130 and 132. The shield 122 is accordingly shaped to cover the additional length of arm 115.

Figure 10:
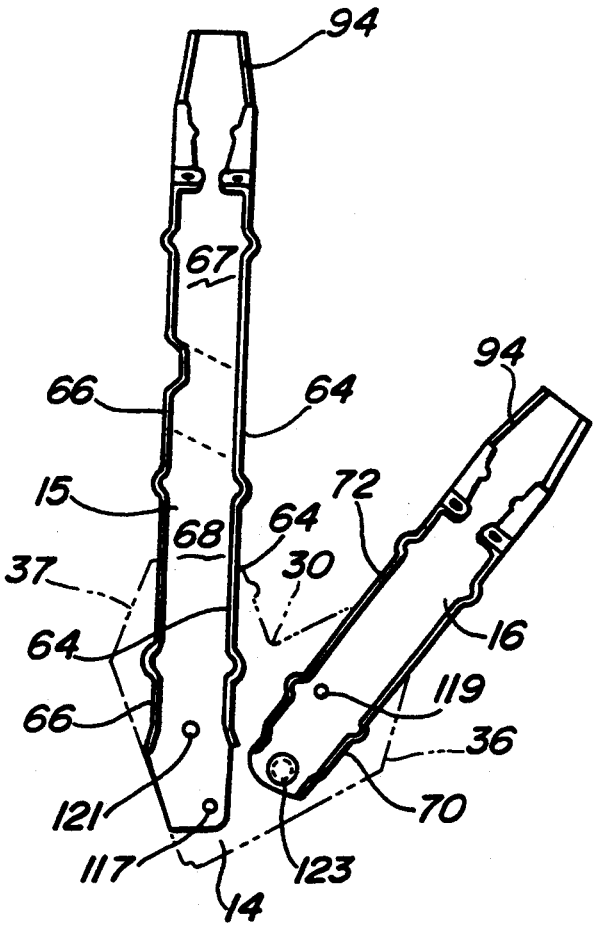
FIG. 10 is a plan view illustrating the method of cutting away the bite section and the inner and outer webs to provide two leg segments.
Figure 11:
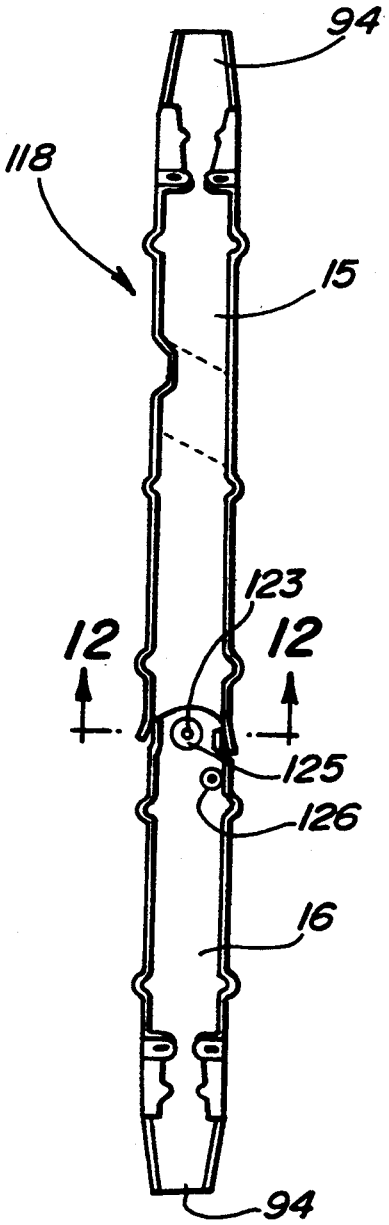
FIG. 11 illustrates the leg segments assembled together to provide a leg as shown in FIG. 2.
Figure 12:
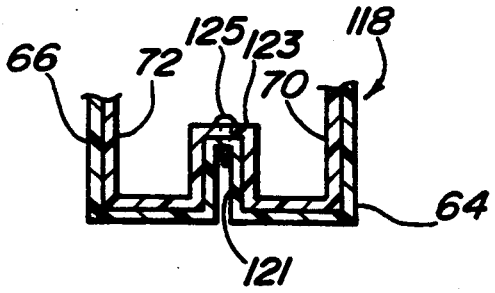
FIG. 12 is a cross-sectional view taken along lines 12—12 shown in FIG. 11.

To describe the formation of leg 118, reference now is made to FIGS. 10–12, an arm brace 12 has the inner and outer webs 30, 36, and 37 removed. A knife or a pair of heavy duty scissors suffices as a tool to remove the material. The bite section 14 is also substantially cut away leaving the two arms 15 and 16 and screw hole 117. The inner end of walls 70 and 72 converge on a narrowing floor 74 while the inner ends of walls 64 and 66 diverge on an expanding floor 67 to allow the inner end of arm 16 to nest within the inner end of arm 15 as shown in FIG. 11 and 12. A post member 121 in arm 15 nests within a socket 123. A screw 125 is secured through the post 121 and socket 123 and screw hole 117 becomes aligned with screw hole 119 to receive a second threaded fastener 126 to fasten the nested arm 16 to arm 15 to form leg 118 as shown in FIG. 11. The distal end 94 of leg 118 can be attached to the distal end 94 of bottom arm 15 to form the longer radiating arm 115 at the bottom of the lighted display as shown in FIG. 2.

Figure 13:
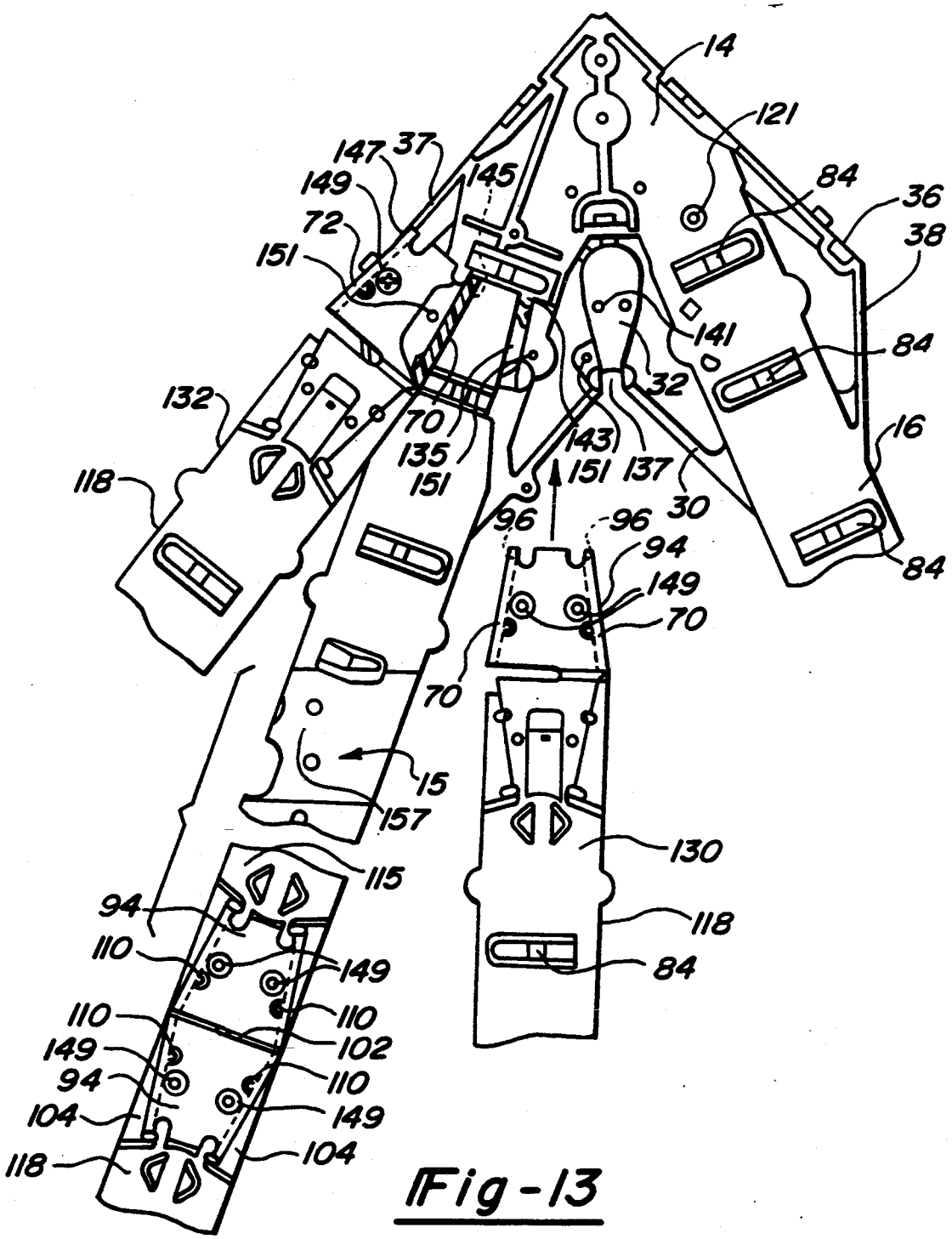
FIG. 13 is an enlarged fragmentary and exploded bottom plan view of the second embodiment shown in FIG. 2 illustrating the connection of the legs to an arm brace.

A leg 118 can also be mounted on each side of arm 115 to form side legs 130 and 132. The distal end is attached to bottom long arm 15 as shown in FIG. 2 near the bite section. As shown in FIG. 13, distal end 94 of leg 130 is connected to the left side of bottom arm 15 and distal end 94 of leg 132 is connected to the right side of bottom arm 15 as viewed from the front.

Tapered wall 70 of the distal end 94 of leg 130 nests in a slot 135 in channel 67 under the holder 80 proximate the bite 14. The tapered wall 72 of distal end 94 of leg 130 also nests within slot 137 cut in the underside of arcuate section 34. Posts 96 fit within respective holes 141 in rigidifying member 32 and aperture 143 in channel floor 67.

Similarly, leg 132 can nest in slot 145 under holder 80 and nesting recess 147 through web 37. Posts 96 fit within slot 145 and recess 147. Both distal ends have apertures 149 that align with apertures 151 for receiving a threaded fastener to secure the legs 130 and 132 to the bottom arm brace 12. Legs 130 and 132 are optional and the embodiment shown in FIG. 2 may be made only with leg 118 attached to the bottom arm 15 to render a more cross-like appearance.

FIG. 3 discloses another embodiment wherein five arm braces 12 are attached together via their distal ends 94 with the bite section 12 forming five points of a star shaped light display. Referring now to FIG. 14, in order to assemble the five star shapes in FIGS. 3 and 4, each arm brace 12 needs to have the rigidifying member 32 removed to allow section 34 in web 30 to flex. The raised corner quadrant 44 is also cut off and a slit 155 is formed through bite 14 to inner side wall 157. The two arms 15 and 16 are then allowed to angularly move from the 45° angular position to a narrower angle of approximately 36°.

A distal end 94 of a long arm 15 is connected to a distal end 94 of a short arm 16 in the same fashion as previously discussed. Another long arm 15 of a second brace overlies the connection of the two distal ends 94 as shown in FIG. 15. The long arm 16 has a raised section 156 with a through tunnel 157 therethrough that provides the passage for distal ends 94. Fastening screws 159 pass through apertures 161 in raised portion 156, through posts 163 and apertures 149 in respective distal ends 94 to help form a rigid structure as shown in FIG. 3.

When the arms 15 and 16 are flexed to the 36° angle, two posts 165 on bite section 14 spread apart to form a socket holder 167 to hold a light 20 at the end of bite section 14 as shown in FIG. 3. An appropriately shaped shield 222 can be used to cover the channels 68 and 76.

As shown in FIG. 4, a larger five point star may be assembled by using five arm braces 12 in conjunction with a second set of five angled arm braces 312. The arm braces 12 are cut and bent as described above for the embodiment in FIG. 3 and as shown in FIG. 13 such that the bite section 14 similarly forms the outer points of the star shape. Each arm brace 312 has a short arm 316 and long arm 315. The arm 312 have distal ends 394 similarly constructed substantially the same as distal ends 94 and are interconnected with distal ends 94 thereto in the same fashion such that a long arm 315 of arm brace 312 is fastened to a short arm 16 of arm brace 12 and the short arm 316 of arm brace 312 is fastened to long arm 15 of arm brace 12. The arm brace 312 forms an inner corner of the star structure. The long arm 315 of arm brace 312 has a light socket holder 380 similarly constructed to previously described holder 80.

In this fashion, an arm brace 312 can be used to assemble a variety of sturdy and decorative light displays and hold a plurality of lights. The channels easily receive and hold a plurality of lights therein and retain the electrical wiring therein. The upward positioning of the light through the shield assures that the lights are positioned for maximum effective illumination. The shield allows the light display to also be an attractive display during daylight hours and may be colored or have graphic designs thereon. The shield because it does not function to support the lights or structure for the lights, may be relatively lightweight and inexpensive to make thus allowing the shields to be easily changed as desired.

Variations and modifications are possible without departing from the scope and spirit of the present invention as defined by the appended claims.

The embodiments in which an exclusive property or privilege is claimed are defined as follows:

1. A display structure for mounting ornamental lights; said display structure characterized by:

a plurality of arm braces connected together;

said arm braces having a respective short arm and a respective long arm connected together at an angle with a central bite section;

said short and long arms having opposing upwardly extending side walls and a center wall forming a channel with an open distal end that is connectable with an open distal end of an arm of another arm brace to form a channel connection for a continuous channel between two arm braces; and at least one arm constructed to provide a light socket holder for a light socket in a light string.

2. A display structure as defined in claim 1 further characterized by:

said channel having a raised portion with a angled tunnel thereunder with the raised portion overlying the distal ends of another two braces such that said distal ends extend through said tunnel and said braces all lie substantially coplanar.

3. A display structure as defined in claim 1 further characterized by:

said distal end having a slot extending perpendicular to the length of said channel;

said distal end having a nesting recess for receiving upwardly extending walls at another respective distal end of another arm brace when each respective distal and respectively engage in the slot of a respective other arm brace.

4. A display structure as defined in claim 1 further characterized by:

said arm braces arranged to form a five point star structure with the bite sections of a first set of braces forming respective outer points of said star structure.

5. A display structure as defined in claim 4 further characterized by:

a decorative shield attachable to the arm braces to cosmetically cover a substantial portion of the arm braces and having apertures therethrough aligned with said socket holders to allow lights mounted in said socket holders to be visible through said apertures.

6. A display structure as defined in claim 4 further characterized by:

said arm braces includes a second set of arm braces;

said arm braces of said second set includes a long arm and short arm connected together at an angle;

said arm braces of the second set interposed between ends of respective arm braces of the first set of arm braces to form the inner corners of said five point star structure.

7. A display structure as defined in claim 6 further characterized by:

said distal ends of both sets of arm braces having a slot extending perpendicular to the length of said channel;

said distal end having a nesting recess for receiving upwardly extending walls at another respective distal end of another arm brace when each respective distal end is respectively engaged in the slot of a respective other arm brace.

8. A display structure as defined in claim 6 further characterized by:

each arm of said arm braces of said first set constructed to provide a light socket holder for a light socket in a light string;

at least one arm of said arm braces of said second set constructed to provide a light socket holder for a light socket in a light string.

9. A display structure as defined in claim 8 further characterized by:

said light socket holder having upright walls forming said holder and said walls having distal ends forming two slots therebetween on opposite sides of said holder with said slots spaced along said channel;

said distal ends of said wall being flexible and resilient to allow a wire of string light to enter and be retained within said slots.

10. A display structure as defined in claim 1 further characterized by:

said light socket holder having upright walls forming said holder and said walls having distal ends forming two slots therebetween on opposite sides of said holder with said slots spaced along said channel;

said distal ends of said wall being flexible and resilient to allow a wire of string light to enter and be retained within said slots.

11. In a display structure for mounting ornamental lights; said display structure characterized by:

a plurality of arm braces having a respective short arm and a respective long arm connected together at an angle with a central bite section;

said short and long arms having opposing side walls and a center wall forming a channel with an open distal end that is connectable with an open distal end of an arm of another arm brace to form a channel connection for a continuous channel between two arm braces; and a light socket holder being affixed in each arm for providing a upright support for a light socket in a light string;

said plurality of arm braces connected together such that the bite sections form a hub and the arms radially extend outwardly and are circumferentially spaced about said hub.

12. A display structure as defined in claim 11 further characterized by:

said bite section including an upraised corner and said side walls of said arms having a slot thereunder spaced from said upraised corner;

a lock ring having a central opening, said ring fitting snugly under said side walls in said slot and said raised corners extending through said central opening such that said raised corners fill said opening and said arms are locked onto said ring and radially extend outward from said ring at circumferentially spaced positions thereabout;

respective abutting side walls of said arms abutting each other and having an alignment device that correctly positions the respective side walls together.

13. A display structure as defined in claim 12 further characterized by:

a decorative shield attachable to the arm braces to cosmetically cover a substantial portion of the arm braces and having apertures therethrough aligned with said socket holders to allow lights mounted in said socket holders to be visible through said apertures.

14. A display structure as defined in claim 11 further characterized by:

said long arms having opposing upwardly extending side walls and a center wall forming a channel with an open distal end that is connected with a second identical open distal end of an arm extension to form a longer arm radiating from said ring; and said distal ends of said long arm and said arm extension having a slot extending perpendicular to the length of said channel;

said respective distal end having a nesting recess for receiving upwardly extending walls of another respective distal end when each respective distal end is respectively engaged in the respective slot of one of a respective other long arm and arm extension.

15. An arm brace for an ornamental light display, said arm brace characterized by:

a short arm and a long arm integrally formed with a center bite section;

a supporting web section interposed between said short and long arms of said bracket to retain said long and short arms at approximately a 45 degree angle;

said bite section having a fastener system for connecting with another bite section of another like arm brace to form a hub of a star structure with said short and long arms circumferentially spaced about said hub and radiating outwardly from said hub;

said supporting web section having a centrally disposed rigidifying member that can be cut from said web section and said bite section can be radially cut to allow said arms to angularly flex toward each other to change the angle from said approximately 45 degree angle to approximately a 36 degree angle;

said arm brace constructed to provide a light socket holder for a light socket in a light string;

said short and long arms having distal ends constructed to be attached to a distal end of a second arm brace when said arms are set at said approximately 36° angle to be able to form a five pointed star structure with said bite section forming said five points.

16. An arm brace as defined in claim 15 further characterized by:

said short and long arms having opposing side walls and a center wall forming a channel with a respective open distal end that is connectable with an open distal end of a respective arm of another arm brace to form a channel connection for a continuous channel between two arm braces.

17. An arm brace as defined in claim 16 further characterized by:

said channel having a raised portion with an angled tunnel with the raised portion constructed to overlie the distal ends of another two identical braces such that said distal ends are able to extend through said tunnel and said braces are able to lie substantially coplanar.

18. An arm brace as defined in claim 16 further characterized by:

said distal end having a slot extending perpendicular to the length of said channel;

said distal end having a nesting recess for receiving upwardly extending walls at another respective distal end of another arm brace when each respective distal end is respectively engaged in the slot of a respective other arm brace.

19. An arm brace as defined in claim 16 further characterized by:

said bite section and said web being removable by cutting from said arm brace such that an inner end of said short arm nests with the inner end of said long arm to provide a straight leg; and a fastener system to secure said inner ends together.

* * * * *